US008449682B2

(12) United States Patent
Perelli et al.

(10) Patent No.: US 8,449,682 B2
(45) Date of Patent: May 28, 2013

(54) SWIVEL BROOM

(75) Inventors: Thomas Perelli, Winchester, VA (US); Grant Mason, Stephens City, VA (US); Matthew Scott Kepner, Stephens City, VA (US); William Michael Charrier, Winchester, VA (US)

(73) Assignee: Rubbermaid Commerical Products, LLC, Winchester, VA (US)

( * ) Notice: Subject to any disclaimer, the term of this patent is extended or adjusted under 35 U.S.C. 154(b) by 57 days.

(21) Appl. No.: 13/089,871

(22) Filed: Apr. 19, 2011

(65) Prior Publication Data

US 2011/0253172 A1 Oct. 20, 2011

Related U.S. Application Data

(60) Provisional application No. 61/325,636, filed on Apr. 19, 2010.

(51) Int. Cl.
*B08B 7/00* (2006.01)

(52) U.S. Cl.
USPC ..... 134/6; 134/42; 15/144.1; 15/144.2; 15/172; 403/92; 403/93; 403/94; 403/96; 403/97; 16/438; 16/900

(58) Field of Classification Search
USPC ..... 15/144.1, 144.2, 172; 134/6, 42; 403/92, 403/93, 94, 96, 97; 16/438, 900
See application file for complete search history.

(56) References Cited

U.S. PATENT DOCUMENTS

| | | | | |
|---|---|---|---|---|
| 2,987,745 | A * | 6/1961 | Ballinger | 15/229.8 |
| 3,006,668 | A * | 10/1961 | Stewart | 403/68 |
| 4,165,550 | A * | 8/1979 | Burke | 15/144.2 |
| 5,471,699 | A * | 12/1995 | Shaw | 15/146 |
| 2005/0132520 | A1 * | 6/2005 | Navarro | 15/172 |
| 2009/0094769 | A1 * | 4/2009 | Wilson | 15/144.1 |
| 2011/0100395 | A1 * | 5/2011 | Van Landingham et al. | 134/6 |

OTHER PUBLICATIONS

Perelli, Thomas, et al., United States Patent and Trademark Office, U.S. Appl. No. 13/089,868, filed Apr. 19, 2011.

* cited by examiner

*Primary Examiner* — Bibi Carrillo
(74) *Attorney, Agent, or Firm* — Dennis J. Williamson; Moore & Van Allen PLLC

(57) ABSTRACT

A broom comprises a head supporting bristles. A handle is connected to the head at a swivel joint where the swivel joint allows the handle to feely rotate relative to the head. A lock is movable to a locked position to fix the position of the handle relative to the head when the head is in a first position relative to the handle and an unlocked position where the head is free to rotate relative to the handle. A method of operating a broom comprises providing a head supporting bristles connected to a handle at a lockable swivel joint; locking the lockable swivel joint to fix the position of the handle relative to the head in a first position; and unlocking the lockable swivel joint to allow the handle to rotate relative to the head.

15 Claims, 8 Drawing Sheets

SWIVEL BROOM

This application claims benefit of priority under 35 U.S.C. §119(e) to the filing date of to U.S. Provisional Application No. 61/325,636, as filed on Apr. 19, 2010, which is incorporated herein by reference in its entirety.

BACKGROUND

A conventional push broom typically comprises a handle fixed in position to the brush head such as by a screwthread connection. The brush head typically has an array of relatively coarse, stiff bristles extending from the bottom of the head such that a user may grasp the handle to push or pull the broom across a floor or other surface. The handle is typically centered on and fixed at a 90 degree angle relative to the long axis of the brush head.

SUMMARY OF THE INVENTION

A broom comprises a head supporting bristles. A handle is connected to the head at a swivel joint where the swivel joint allows the handle to feely rotate relative to the head. A lock is movable to a locked position to fix the position of the handle relative to the head when the head is in a first position relative to the handle and an unlocked position where the head is free to rotate relative to the handle.

When the broom is in the first position the head may be at a 90 degree angle relative to the handle. In the unlocked position the head may be free to pivot 180 degrees relative to the handle. The swivel joint may comprise a pivot pin where the handle may pivot relative the head about the pivot pin. The swivel joint may comprise opposed flanges on the head and the handle may comprise a yoke that is dimensioned to be received between the pair of flanges and that defines an aperture that receives the pivot pin. The lock may comprise a latch that is disposed on one of the head or the handle such that the latch may be extended in a first direction toward and withdrawn in a second direction away from the other one of the head or handle. The latch may be biased in the first direction. The latch may comprise a cam surface. An actuator may be mounted to the other one of the head or handle for pivoting motion between a first locked position and a second unlocked position. The actuator may comprise a finger that contacts the latch. A detent assembly may fix the actuator in the first locked position and the second unlocked position. A series of recesses may be formed on the other one of the head or handle, the recesses being engageable by the latch to prevent rotation of the head relative to the handle. One of the plurality of recesses may be aligned with a longitudinal axis of the handle. A second one of the plurality of recesses may be spaced from the one of the plurality of recesses by 90 degrees. A third one of the plurality of recesses may also be spaced the one of the plurality of recesses by 90 degrees. A first surface may be formed between the one of the plurality of recesses and the second one of the plurality of recesses and a second surface may be formed between the second one of the plurality of recesses and the third one of the plurality of recesses where the latch contacts the first surface and the second surface. The first surface and the second surface may be formed as arcs of a circle centered about the swivel joint.

A method of operating a broom comprises providing a head supporting bristles connected to a handle at a lockable swivel joint; locking the lockable swivel joint to fix the position of the handle relative to the head in a first position; and unlocking the lockable swivel joint to allow the handle to rotate relative to the head. The method may further comprise locking the lockable swivel joint to fix the position of the handle relative to the head in a second position. In the first position the head may be perpendicular to the handle and in the second position the head may be parallel to the handle.

DETAILED DESCRIPTION OF EMBODIMENTS OF THE INVENTION

Figure 1:
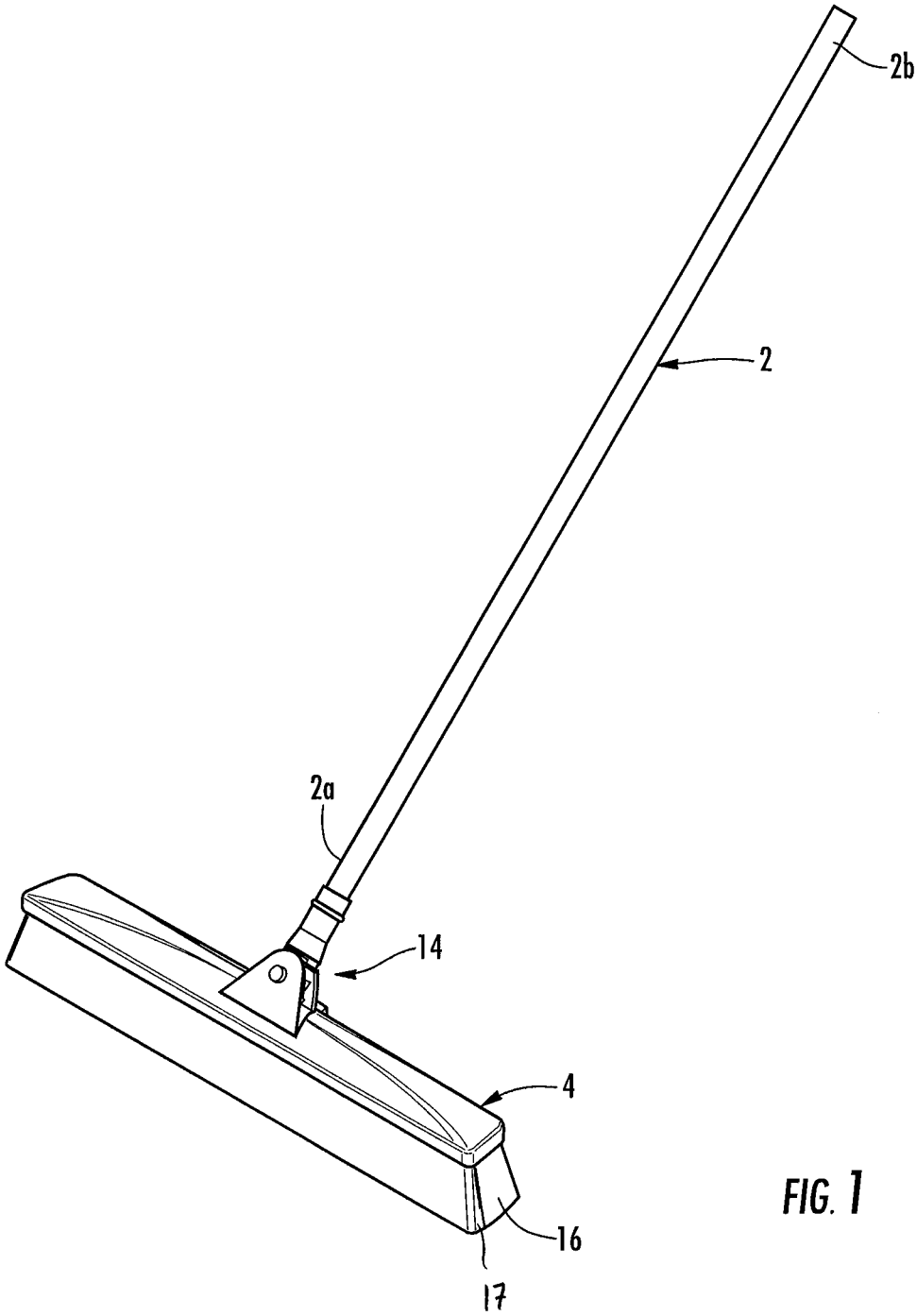
FIG. 1 is a front perspective view of an embodiment of the broom of the invention.
Figure 2:
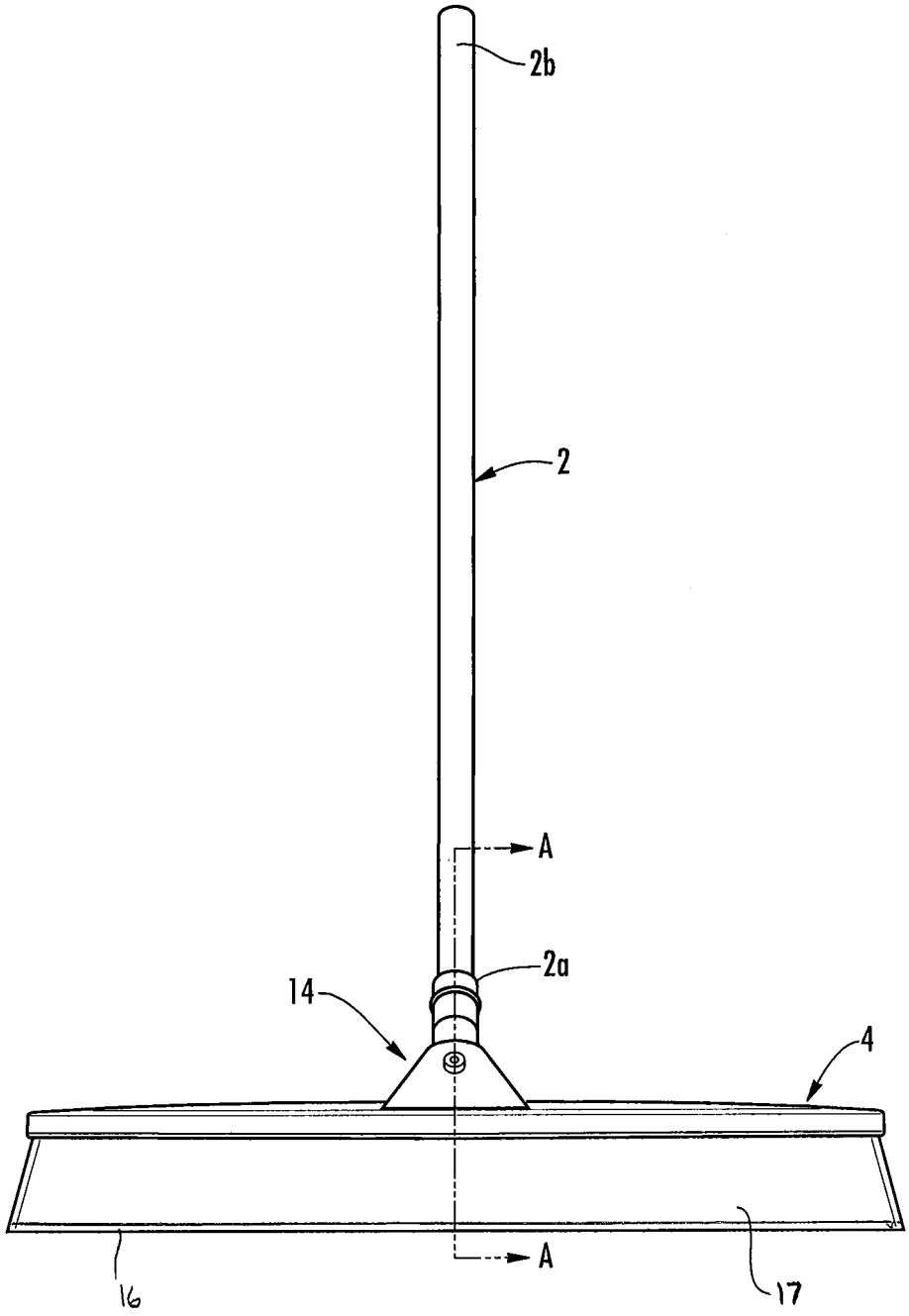
FIG. 2 is a front view of the broom of FIG. 1.
Figure 10:
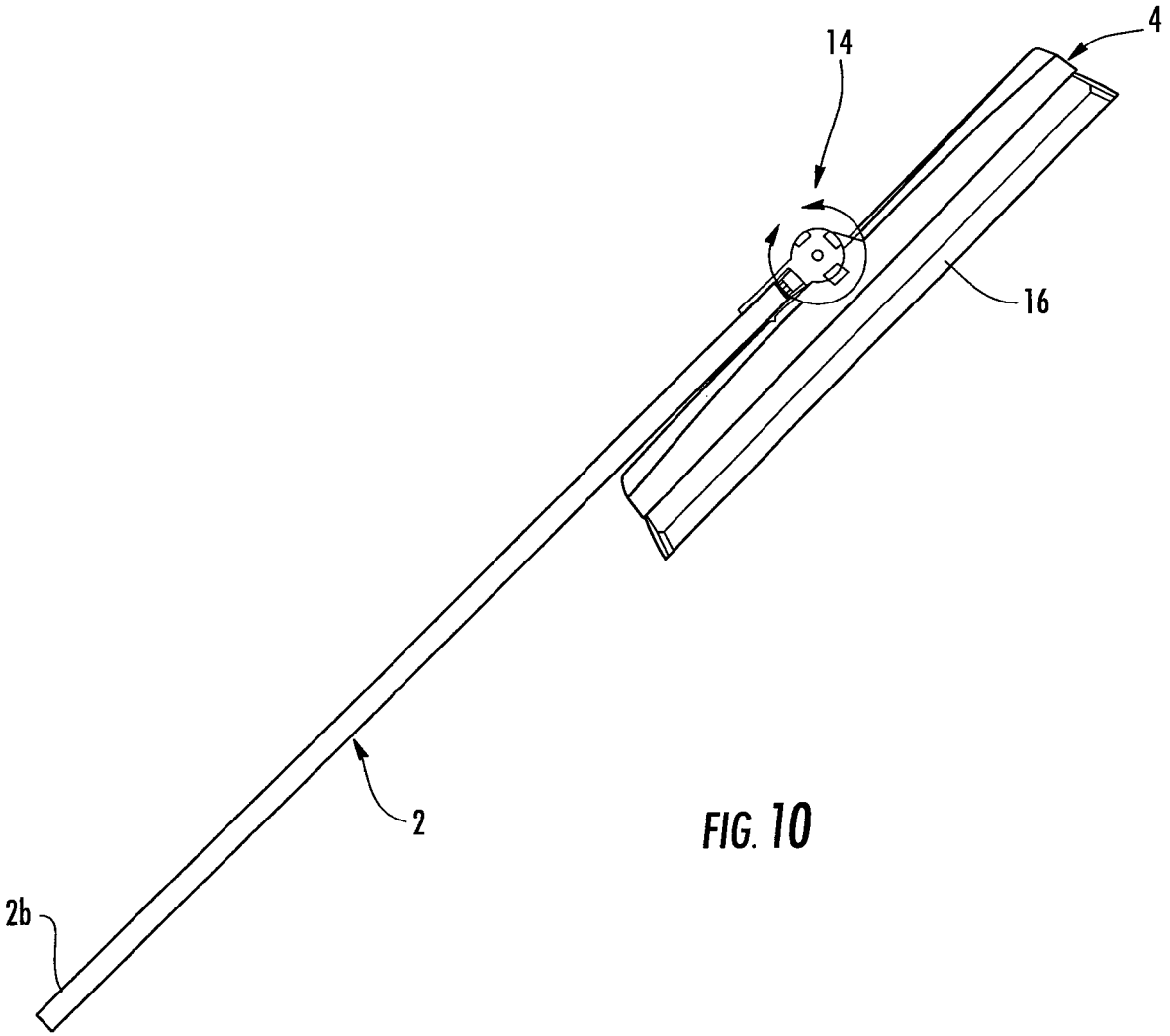
FIG. 10 shows the broom in a storage position.
Figure 11:
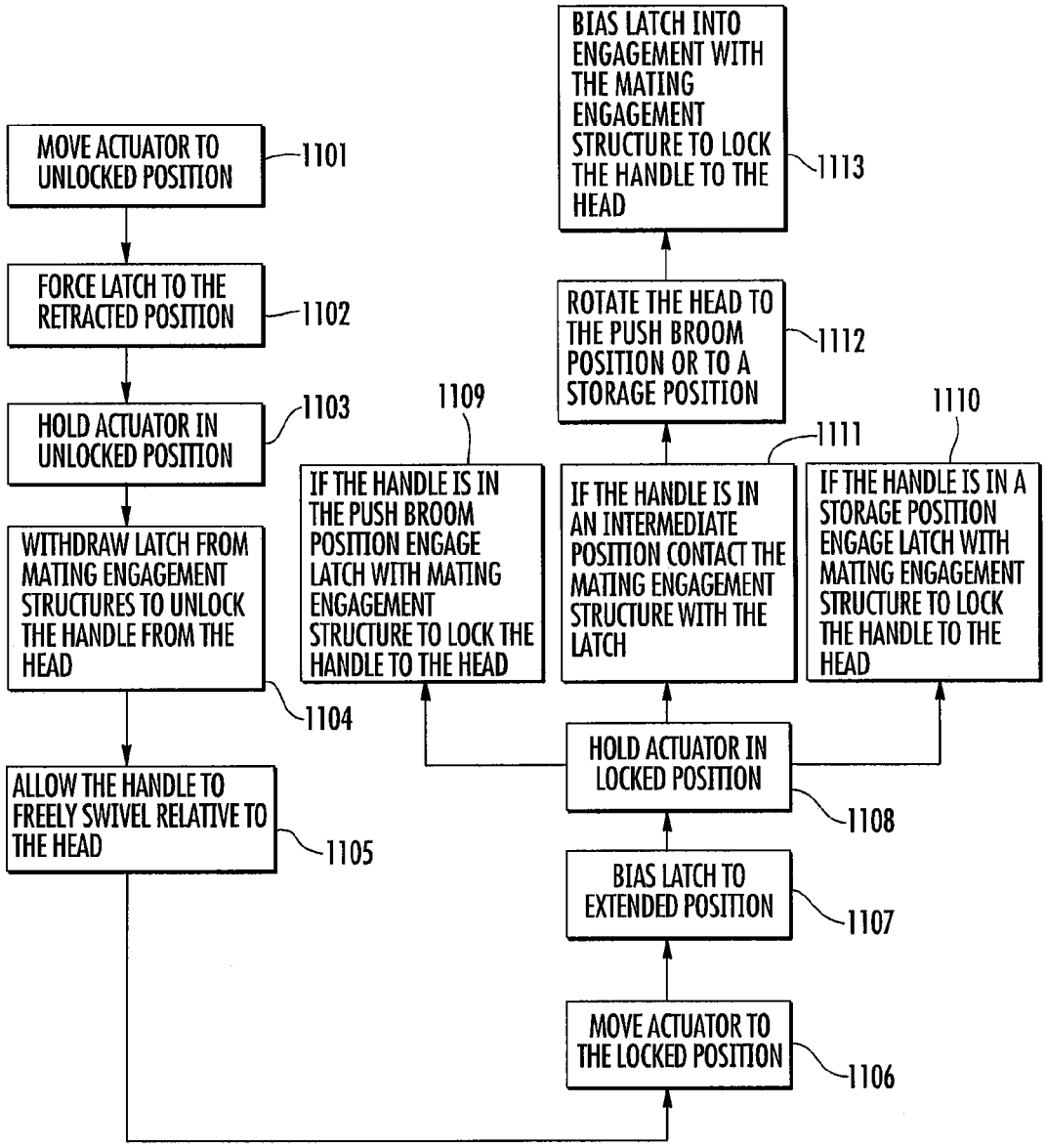
FIG. 11 is a block diagram illustrating an embodiment of a method of using the broom of the invention.

The swivel push broom comprises broom head 4 connected to the handle 2 at a lockable swivel joint 14. In the locked mode of operation the broom is configured as shown in FIG. 1 where the handle 2 is perpendicular to the long axis of the head 4 and operates in a manner similar to a conventional broom. In the unlocked mode the handle 2 is centered on the head 4 but it is free to pivot 90 degrees to the left or the right relative to the head. This 180 degree pivoting motion of the brush head relative to the handle allows the user to sweep the broom in a manner similar to the motion used with a flat mop where either end of the brush head can be turned to point forwards while keeping the handle aligned with the user. This allows the user to sweep in a figure eight motion similar to when using a flat mop such that the brush head can quickly cover a larger floor area with less back and forth movement of the user's arms than with a traditional push broom. The swiveling head also allows the head to penetrate narrow spaces without the handle bumping into things and becoming its own obstacle or requiring the user to position themselves awkwardly. Moreover, a single sweep motion can be made continuously along a wall that has an assortment of nooks and crannies from boxes, furniture, equipment, or the like. The head rotates as needed to get into tight spaces with one fluid motion and a more natural position for the user. The swivel joint also allows either end of the brush head to be folded against the handle to the storage position of FIG. 10 where the brush head is parallel to the long axis of the handle for narrow and compact storage. The broom head may be provided with angled bristles on the front edge to allow the user to push and follow through with a standard sweep motion.

In one embodiment the broom comprises a handle 2 that has a first end 2*a* that is connected to broom head 4 as will hereinafter be described and a second end 2*b* that is spaced from the first end and may be provided with a hand grip that may be grasped by an end user during use of the broom. To provide the swiveling functionality of the broom head 4, the broom head 4 is connected to the handle 2 at a locking swivel joint 14. The head 4 comprises an array of bristles 16 on the side opposite handle 2. The head also comprises a section of bristles 17 that are arranged at the front edge of head 4 and that have a floor engaging surface 17*a* that is arranged at approximately a 10 degree angle relative to the floor engaging surface 16*a* of bristles 16 as shown for example in FIG. 4.

Figure 3:
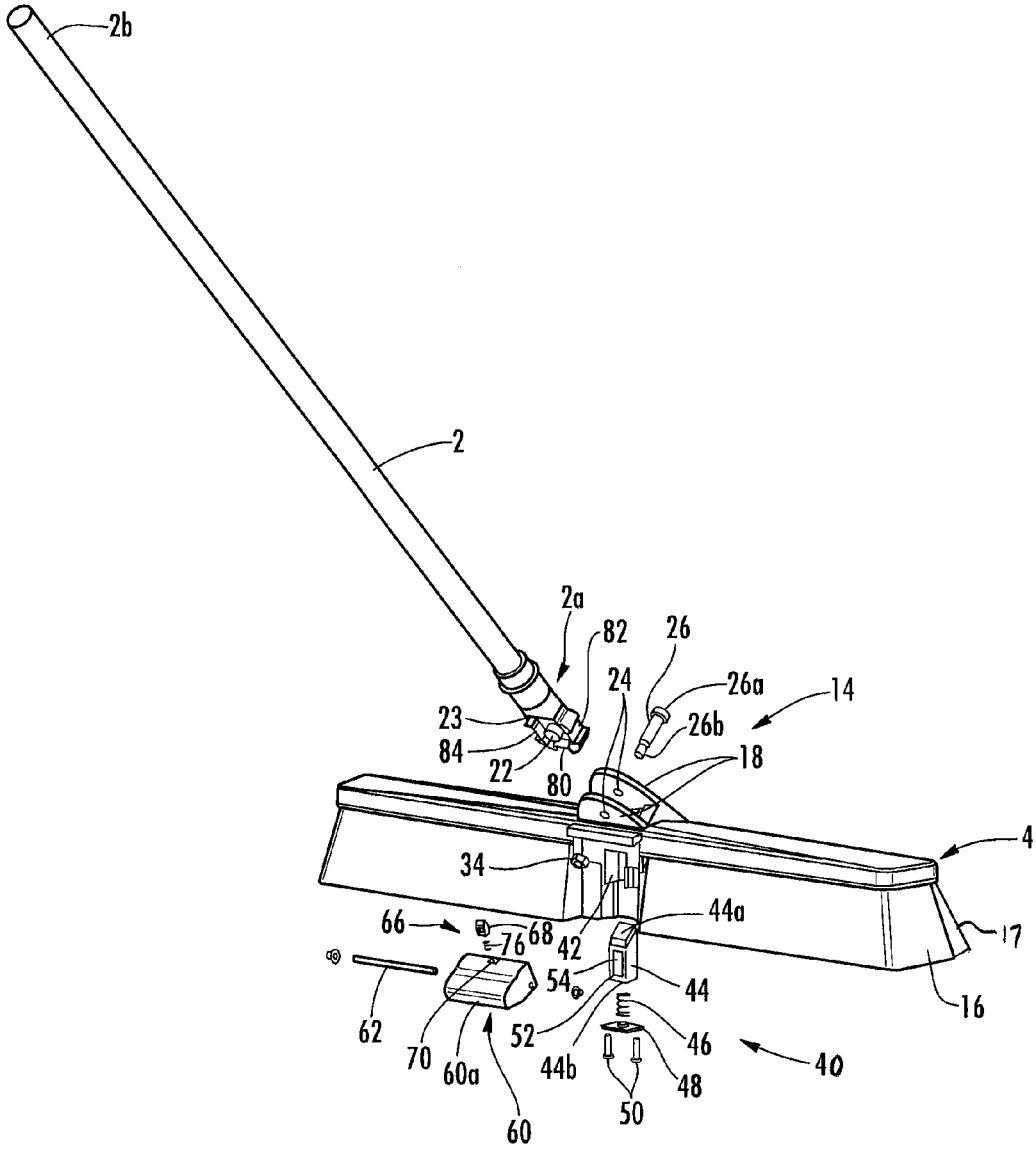
FIG. 3 is an exploded rear perspective view of the broom of FIG. 1.
Figure 4:
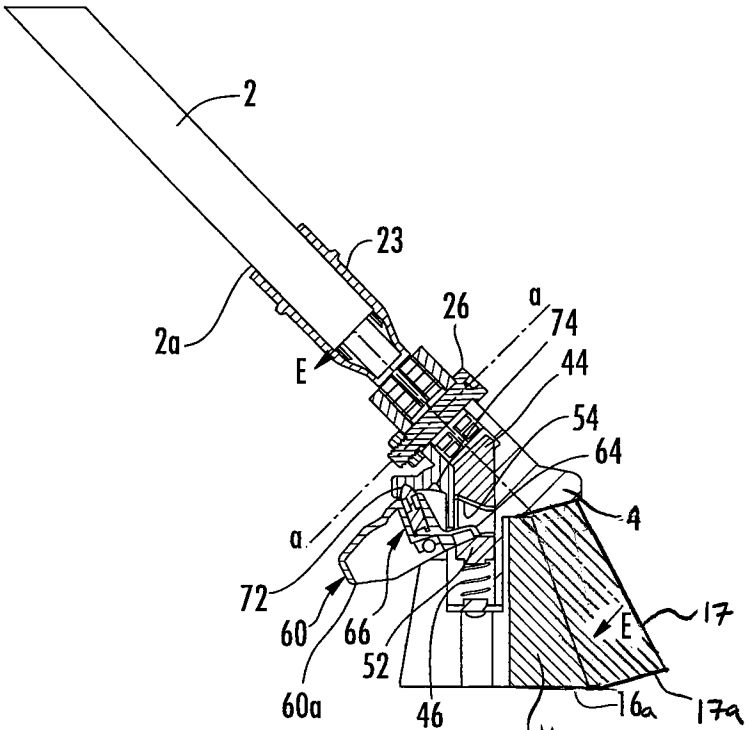
FIG. 4 is a section view taken along line A-A of FIG. 2 showing the broom in the locked position.
Figure 7:
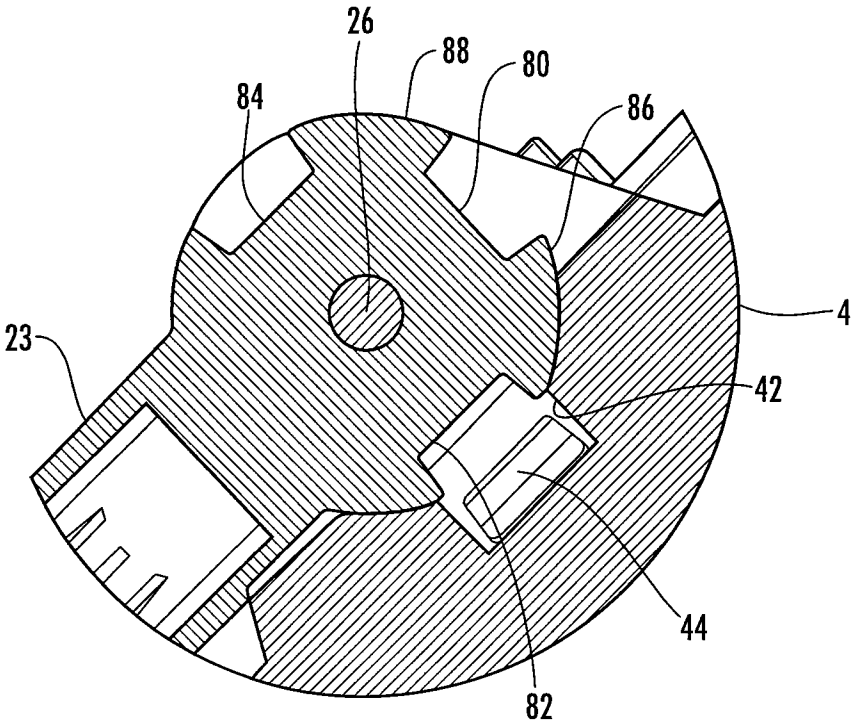
FIG. 7 is a section view taken along line G-G of FIG. 6.

Referring to FIG. 3, pivot joint 14 comprises opposed flanges 18 provided on head 4 where each of the flanges 18 is provided with an aperture 24. The flanges 18 are disposed at an angle relative to the head 4 such that the handle 2 is disposed at a comfortable angle relative to head 4 when head 4 is on a floor or other surface. The apertures 24 are aligned to receive a pivot pin 26. The end 2*a* of handle 2 comprises a yoke 23 that is dimensioned to be received between the pair of flanges 18 and comprises an aperture 22 that also receives the pin 26 such that the head 4 may pivot relative to handle 2 about the longitudinal axis of pin 26. In the illustrated embodiment the pivot pin 26 comprises a threaded member having a head 26*a* on one end and threads 26*b* on the other end that is inserted through the aligned apertures 22, 24. A threaded nut 34 engages the screw threads 26*b* to secure the pivot pin 26 in position with the yoke 23 trapped between flanges 18. The pivot joint 14 allows the handle 2 to pivot relative the head 4 about axis a-a (FIG. 4).

A lock 40 is provided to lock the head 4 relative to the handle 2 in a traditional push broom configuration, a storage position and may be unlocked to allow the head 4 to pivot relative to the handle 2 about pin 26. The lock 40 comprises a receptacle 42 in the form of a through hole in the head 4 that opens into the area between the flanges 18. A latch 44 is disposed in the receptacle 42 such that is can slide in receptacle 42 in a reciprocating manner such that the end 44*a* of the latch may be extended in a first direction toward handle 2 and retracted in a second direction away from handle 2. The latch 44 is biased in the first direction toward the end 2*a* of handle 2. In the illustrated embodiment a compression spring 46 is trapped between the end 44*b* of the latch 44 and a plate 48. The end 44*b* of latch 44 and plate 48 may be provided with protrusions to seat spring 46. The plate 48 is secured over the end of the receptacle 42 by screws 50. The center of latch 44 is formed with a cam surface 52 formed as a part of a recess or aperture 54 that is engaged by an actuator 60 to move the latch 42 between the locked and unlocked position as will be described.

The actuator 60 is mounted to head 4 opposite to latch 44 for pivoting motion between a first locked position and a second unlocked position. In the illustrated embodiment a pivot axle 62 is mounted on head 4 such that the actuator 60 may pivot about axle 62. The actuator 60 is mounted on head 4 such that it may be conveniently actuated by a user's foot when the head 4 is on a floor such as during normal use of the broom. The actuator 60 comprises a finger 64 (FIG. 4) that extends into the recess 54 and is contacted by the cam surface 52 of latch 44. Because the latch 44 is biased upwards by spring 46 cam surface 52 is continuously biased into engagement with the bottom of finger 64.

The actuator 60 may be secured in a locked position and an unlocked position relative to the head 4 by detent assembly 66. Detent assembly 66 comprises a lever 68 supported in a recess 70 formed in actuator 60 such that the lever may move between an extended retracted and extended position. The lever 68 is biased to the extended position by a compression spring 76 that is compressed between lever 68 and the end of recess 70. The lever 68 may engage one of two detents 72 and 74 formed in the head 4 opposite to the lever 68. When the lever 68 is in the first detent 72 the actuator is in the locked position of FIG. 4 where finger 64 is rotated towards handle 2 allowing latch 44 to extend toward handle 2. When the lever 68 is in the second detent 74 the actuator 60 is in the unlocked position of FIG. 6 where finger 64 is rotated away from handle 2 such that finger 64 pulls the latch 42 to the retracted position away from the handle 2. The force of spring 76 may be overcome by a user pivoting actuator 60 about axle 62.

Latch 44 cooperates with a series of mating engagement structures connected to handle 2 to lock the handle 2 relative to the head 4 in one of three positions where swiveling of the handle 2 relative to the head 4 is prevented. In the illustrated embodiment the mating engagement structures comprise recesses 80, 82 and 84 formed on yoke 23 although the engagement structures may have other configurations provided that the latch can engage the structure to lock the head to the handle. Yoke 23 may be made of molded plastic and is secured to the end 2*a* of handle 2 by a screwthread connector or the like. The recesses 80, 82 and 84 are spaced about the periphery of yoke 23. Center recess 80 is located at the end of yoke 23 and is aligned with the longitudinal axis of handle 2. Recesses 82 and 84 are spaced in the opposite directions from recess 80 by 90 degrees about hole 22. The recesses 80, 82 and 84 are dimensioned such that the end 44*a* of latch 44 may be inserted into each of recesses 80, 82 and 84. The engagement of latch 44 with any one of the recesses 80, 82 and 84 prevents the yoke 23 and handle 2 from rotating relative to head 4. The surfaces 86 and 88 between recesses 80, 82 and 84 are formed as arcs of a circle centered about pivot pin 26 that ride on complimentary arced surfaces 90 and 92 on head 4 to facilitate the rotation of handle 2 relative to head 4. Further the surfaces 86 and 88 may be contacted by the latch when the latch is in the locked position but the head is in an intermediate position relative to the handle between the conventional push broom position and the locked positions as will be described. The surfaces 86 and 88 should have a shape such that when the head is in an intermediate position contact between the latch 44 and the surfaces 86 and 88 does not lock the head relative to the handle and movement between the head and handle is allowed.

Figure 5:
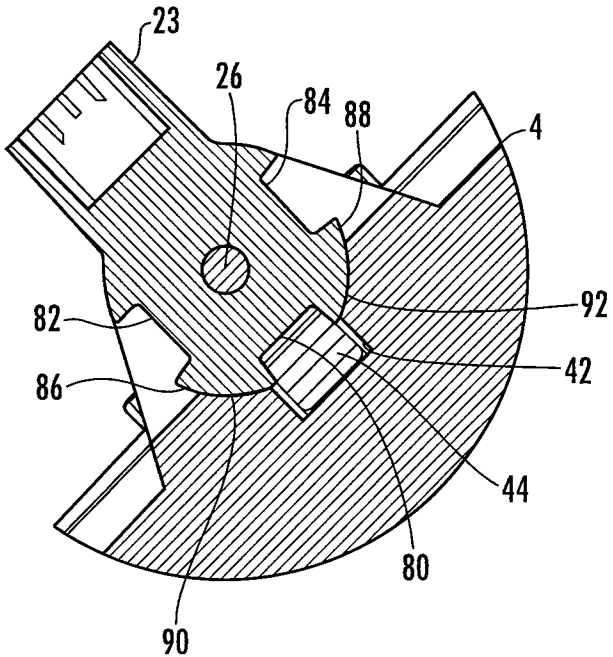
FIG. 5 is a section view taken along line E-E of FIG. 4.

The operation of the broom provided as described above will be described assuming that the broom is in the configuration of FIG. 1 and that the lock is in the locked position of FIGS. 4 and 5. In this configuration the broom may be used as a conventional push broom with the user standing or walking behind head 4 and pushing or pulling on handle 2. The handle 2 is locked to head 4 at a 90 degree angle by locking swivel 14 such that the handle 2 cannot move relative to head 4. Referring to FIGS. 4 and 5 the actuator 60 is in the locked position with the distal end 60*a* of actuator 60 rotated downward and finger 64 rotated upward toward the handle 2. The lever 68 is biased into engagement with detent 72 to hold the actuator 60 in this position. Because finger 64 is rotated toward the handle 2, spring 46 biases the latch 44 to the extended position toward handle 2 such that the end 44*a* of latch 44 is biased into engagement with yoke 23 by spring 46. Because the handle is disposed at a right angle relative to the head 4, center recess 80 is disposed opposite latch 44 and latch 44 is located in recess 80. The engagement of latch 44 with the recess 80 locks the handle 2 in position relative to head 4 in the conventional push broom configuration of FIG. 1.

Figure 6:
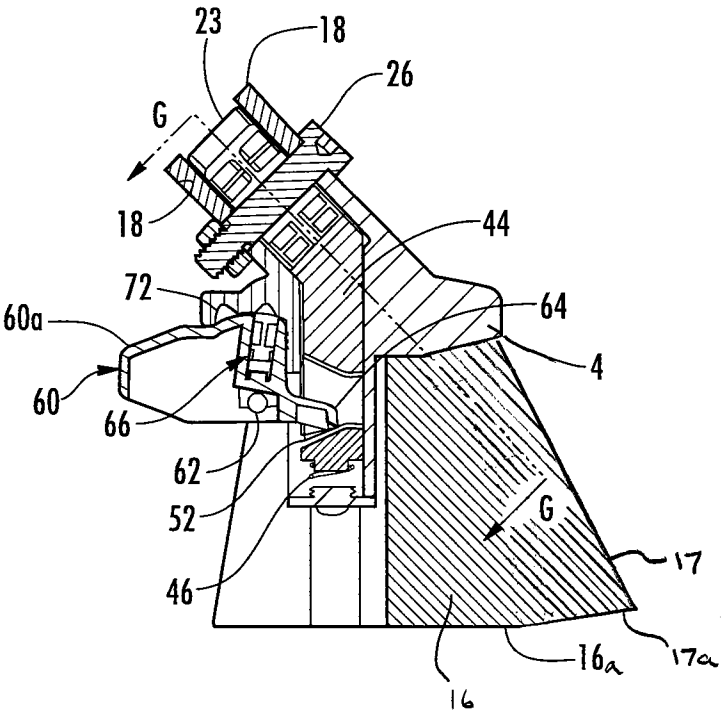
FIG. 6 is a section view similar to FIG. 4 showing the broom in the unlocked position.

To unlock the handle 2 from the head 4, the user lifts the end 60*a* of actuator 60, such as by using the toe of the user's foot, to move actuator 60 to the unlocked position of FIG. 6 (block 1101). As the actuator 60 moves to the unlocked position of FIG. 6 finger 64 presses against the cam surface 52 to force the latch 44 away from the yoke 23 (block 1102). The lever 68 is biased into engagement with detent 74 to hold the actuator 60 in this position (block 1103). As the latch 44 moves away from yoke 23 the end of latch 44*a* is withdrawn from the recess 80 such that the handle 2 is free to rotate relative to head 4 about pin 26 (block 1104). In the unlocked mode the handle 2 is centered on the head 4 but it is free to pivot 90 degrees to the left or the right relative to the head (block 1105). This 180 degree pivoting motion of the head 4 relative to the handle 2 allows the user to sweep the broom in a manner similar to that used with a flat mop. Referring to FIG. 4, in one use of the broom the user may stand in front of the broom (to the right as viewed in FIG. 4) and tilt the entire broom including the handle 2 and head 4 to the right such that the handle is disposed at approximately a 45 degree angle to the floor in front of the broom (as opposed to a 45 degree angle behind the broom as illustrated). Angling the broom in such a manner tilts the angled bristle area 17 into contact with the floor where the leading bristles 17 are at approximately a thirty degree angle relative to the floor. It has been found that bristles disposed at such an angle facilitate the dirt collection when the broom is used with the mopping swiveling action. Moreover, when the broom is used in the orientation shown in FIG. 4 with the head free to swivel and the user using a figure-8 mopping action the angled surface 17*a* allows the broom to turn smoothly without the front edge of the bristles "catching" on the ground and causing the broom head 4 to turn too severely. Without the angled area 17*a* the leading edge of the bristles may cause the head to over pivot. The transition point between area 16*a* and area 17*a* is selected to provide sufficient surface area of the bristles in area 16*a* that the broom may function as a traditional push broom yet provide sufficient area of the bristles in area 17*a* to allow the broom to turn smoothly when used in the forward moving, swiveling figure-8 motion. Either end of the brush head may be turned to point forwards while keeping the handle aligned with the user. This allows the user to sweep in a figure eight motion similar to when using a flat mop such that the brush head can quickly cover a larger floor area with less back and forth movement of the user's arms than with a traditional push broom.

The handle 2 may be relocked relative to the head either to convert the broom back to the conventional push broom configuration or to a storage configuration. To lock the handle to the broom the user depresses the end 60*a* of actuator 60, such as by using the toe of the user's foot, to move actuator 60 to the locked position of either FIG. 4 or FIG. 8 (block 1106). Because finger 64 is rotated toward the handle 2, spring 46 biases the latch 44 to the extended position toward handle 2 such that the end 44*a* of latch 44 is biased into engagement with yoke 23 (block 1107). The lever 68 is biased into engagement with detent 72 to hold the actuator 60 in this position (block 1108). The actuator 60 may be moved to locked position with the handle 2 at any angular position relative to the head. If the handle is in the conventional push broom configuration of FIG. 1 (where handle 2 is at a 90 degree angle relative to the longitudinal axis of head 4) the latch 44 is biased into engagement with center recess 80 (block 1109). If the head is in the storage position of FIG. 10 where it is rotated 90 degrees in either direction so as to be parallel to the handle 2 the latch 44 is biased into engagement with either recess 82 or 84 (block 1110). If the head is rotated in one direction 90 degrees recess 82 is used to hold the head in the storage position and if the head is rotated in the opposite direction 90 degrees recess 84 is used to hold the head in the storage position.

Figure 9:
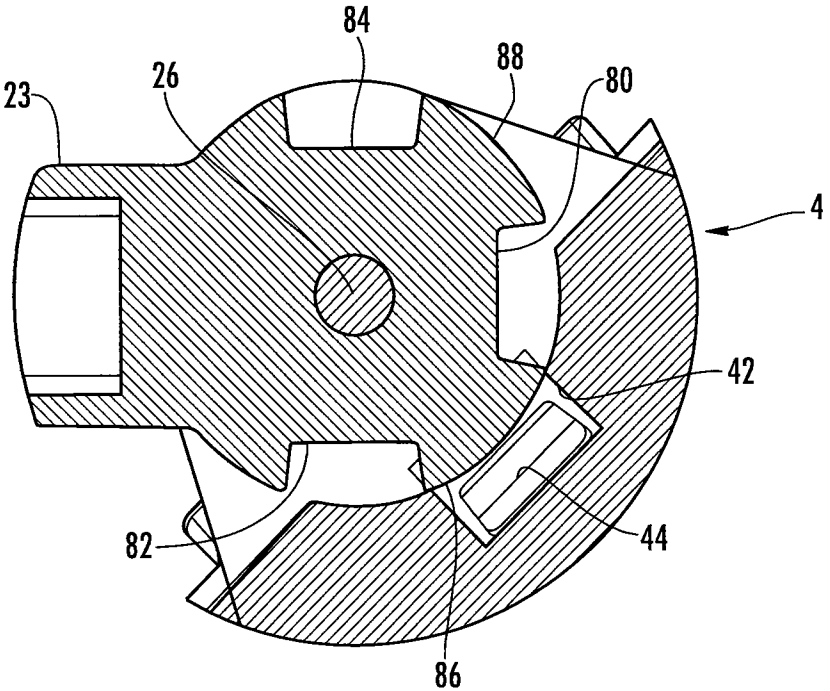
FIG. 9 is a section view taken along line J-J of FIG. 1.
Figure 8:
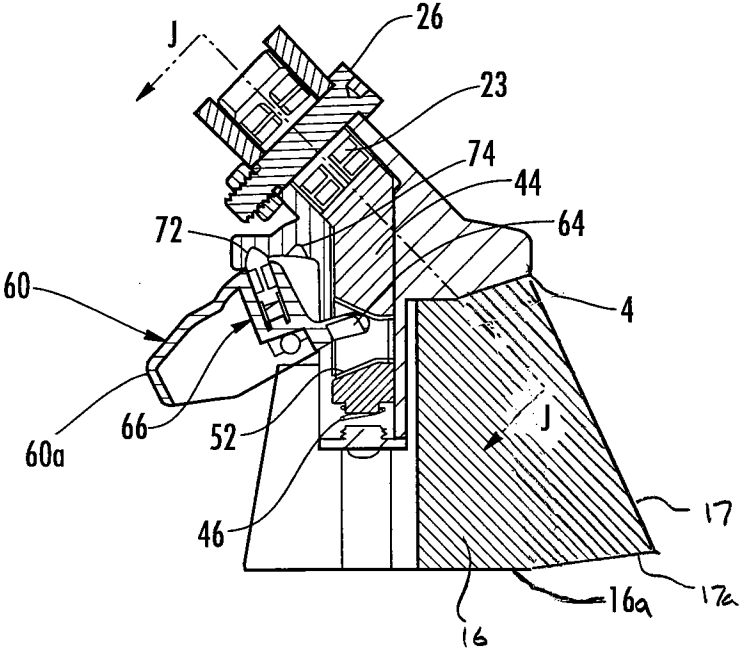
FIG. 8 is a section view similar to FIG. 4 showing the broom in a second unlocked position.

If the head 4 is in any intermediate position between the conventional push broom position (FIG. 1) and the storage positions (FIG. 10), the end of latch 44 is biased against arcuate surface 86 or arcuate surface 88 as shown in FIGS. 8 and 9 (block 1111). In this position the handle 2 is not locked to the head 4 even though actuator 60 is in the locked position because latch 44 is not engaged with one of recesses 80, 82 and 84. The user may then rotate the handle 2 relative to the head 4 to either move the head 4 to one of the two storage positions or to the conventional push broom position (block 1112). When any one of these positions is reached, the spring 46 forces the latch 44 into engagement with one of recesses 80, 82 and 84 to lock the head to the handle (block 1113).

The embodiments of the invention are disclosed herein, various changes and modifications can be made without departing from the spirit and scope of the invention as set forth in the claims. One of ordinary skill in the art will recognize that the invention has other applications in other environments. Many embodiments are possible. The following claims are in no way intended to limit the scope of the invention to the specific embodiments described above.

The invention claimed is:

1. A broom comprising:

a head supporting bristles;

a handle connected to the head at a swivel joint, the swivel joint allowing the handle to freely rotate relative to the head, the handle further comprising a yoke;

a lock movable to a locked position to fix the handle relative to the head when the head is in a first position relative to the handle and an unlocked position where the head is free to rotate relative to the handle wherein the lock comprises a latch disposed on the head such that the latch may be extended in a first direction toward and withdrawn in a second direction away from the yoke and a plurality of recesses formed on the yoke, the recesses being engageable by the latch to prevent rotation of the head relative to the handle.

2. The broom of claim 1 where in the first position the head is at a 90 degree angle relative to the handle.

3. The broom of claim 1 wherein in the unlocked position the head is free to pivot 180 degrees relative to the handle.

4. The broom of claim 1 wherein the swivel joint comprises a pivot pin where the handle may pivot relative to the head about the pivot pin.

5. The broom of claim 1 wherein the latch is biased in the first direction.

6. The broom of claim 1 wherein the latch comprises a cam surface.

7. The broom of claim 1 wherein one of the plurality of recesses is aligned with a longitudinal axis of the handle.

8. The broom of claim 4 wherein the swivel joint comprises opposed flanges on the head and the yoke is dimensioned to be received between the opposed flanges and defines an aperture that receives the pivot pin.

9. The broom of claim 6 further comprising an actuator mounted to the head for pivoting motion between a first locked position and a second unlocked position.

10. The broom of claim 7 wherein a second one of the plurality of recesses is spaced from the one of the plurality of recesses by 90 degrees.

11. The broom of claim 9 wherein the actuator contacts the cam surface.

12. The broom of claim 9 further comprising a detent assembly for fixing the actuator in the first locked position and the second unlocked position.

13. The broom of claim 10 wherein a third one of the plurality of recesses is spaced from the one of the plurality of recesses by 90 degrees.

14. The broom of claim 13 further comprising a first surface between the one of the plurality of recesses and the second one of the plurality of recesses and a second surface between the second one of the plurality of recesses and the third one of the plurality of recesses, the latch contacting the first surface and the second surface.

15. The broom of claim 14 wherein the first surface and the second surface are formed as arcs of a circle centered about the swivel joint.

* * * * *

UNITED STATES PATENT AND TRADEMARK OFFICE

CERTIFICATE OF CORRECTION

PATENT NO. : 8,449,682 B2
APPLICATION NO. : 13/089871
DATED : May 28, 2013
INVENTOR(S) : Thomas Perelli et al.

It is certified that error appears in the above-identified patent and that said Letters Patent is hereby corrected as shown below:

On the title page, change (73) Assignee to:

RUBBERMAID COMMERCIAL PRODUCTS, LLC, Winchester, VA (US)

Signed and Sealed this
Thirteenth Day of August, 2013

Teresa Stanek Rea

Teresa Stanek Rea
*Acting Director of the United States Patent and Trademark Office*